US005378121A

United States Patent [19]

Hackett

[11] Patent Number: 5,378,121

[45] Date of Patent: Jan. 3, 1995

[54] PUMP WITH FLUID BEARING

[76] Inventor: William F. Hackett, 79028 Lake Club Dr., Bermuda Dunes, Calif. 92201

[21] Appl. No.: 98,553

[22] Filed: Jul. 28, 1993

[51] Int. Cl.[6] ..... F04B 17/00

[52] U.S. Cl. ..... 417/363; 417/369; 417/370; 417/423.12

[58] Field of Search ..... 417/366, 369, 423.12, 417/423.11, 363, 370

[56] References Cited

U.S. PATENT DOCUMENTS

| | | | |
|---|---|---|---|
| 1,908,627 | 5/1933 | Moran et al. . | |
| 2,520,880 | 8/1950 | Harlamoff . | |
| 3,022,739 | 2/1962 | Herrick et al. | 417/369 |
| 3,118,384 | 1/1964 | Sence et al. | 417/423.12 |
| 3,398,687 | 8/1968 | Yoshikawa . | |
| 3,398,694 | 8/1968 | Lerch . | |
| 3,433,163 | 3/1969 | Sheets et al. . | |
| 4,768,925 | 9/1988 | Geupel | 417/363 |
| 4,822,258 | 4/1989 | Matsuda et al. . | |
| 4,966,532 | 10/1990 | Fengsheng . | |
| 5,040,594 | 8/1991 | Iwai . | |
| 5,055,006 | 10/1991 | Kobayashi et al. | 417/366 |
| 5,088,900 | 2/1992 | Yoshioka et al. . | |
| 5,118,264 | 6/1992 | Smith | 417/423.11 |
| 5,151,016 | 9/1992 | Her . | |
| 5,178,523 | 1/1993 | Cheng-Chung | 417/366 |

FOREIGN PATENT DOCUMENTS

| | | | |
|---|---|---|---|
| 0537937 | 3/1957 | Canada | 417/370 |

*Primary Examiner*—Richard A. Bertsch
*Assistant Examiner*—M. Kocharov
*Attorney, Agent, or Firm*—Townsend and Townsend Khourie and Crew

[57] ABSTRACT

A pump including a submersible motor sealed within a motor chamber, an impeller rotatably mounted in an impeller chamber, and motor and impeller shafts coupled to one another to interconnect the motor and impeller. The impeller pumps fluid from the impeller chamber into the motor chamber where the fluid flows around the motor to cool the motor and muffle the motor noise before being discharged from the pump. The impeller shaft is rotatably mounted in a bearing fixed to the impeller housing and having grooves facing the shaft and providing fluid communication between the impeller and motor chambers. Fluid flows into the grooves from the impeller or motor chamber depending on the pressure gradient across the bearing, which varies according to downstream pump conditions (e.g., pressure). As the impeller shaft continues to rotate, fluid from the grooves forms a thin lubricating film in the clearance space provided between the impeller shaft and bearing. With this construction, the need for conventional impeller shaft seals is eliminated.

18 Claims, 3 Drawing Sheets

PUMP WITH FLUID BEARING

BACKGROUND OF THE INVENTION

The present invention relates to circulation pumps generally, and more particularly, to end suction centrifugal pumps.

Conventional liquid pumps typically comprise a motor, an impeller housing, and an impeller rotatably mounted in a chamber formed in the housing. The motor drives the impeller which then draws liquid into the impeller chamber and pumps the liquid to the desired location. A seal is positioned in the impeller housing and around the impeller shaft so that liquid is prevented from leaking from the liquid-containing impeller chamber along the shaft. Among the disadvantages of these pumps is that these seals wear and leak and, thus, generally must be periodically replaced to avoid damage to the equipment adjacent to the impeller housing.

SUMMARY OF THE INVENTION

The present invention is directed to a pump that avoids the problems and disadvantages of the prior art. The invention accomplishes this goal with a pump comprising a submersible motor sealed within a motor chamber, an impeller rotatably mounted in an impeller chamber, and motor and impeller shafts coupled to one another to interconnect the motor and impeller. The impeller pumps fluid from the impeller chamber into the motor chamber where the fluid flows around the motor and is subsequently discharged from the pump. The impeller shaft is rotatably mounted in a bearing fixed to the impeller housing and having grooves facing the shaft and providing fluid communication between the impeller and motor chambers. Fluid flows into the grooves from the impeller or motor chamber depending on the pressure gradient across the bearing, which varies according to downstream pump conditions (e.g., pressure). As the impeller shaft continues to rotate, fluid from the grooves forms a thin lubricating film in the clearance space provided between the impeller shaft and bearing. With this construction, the need for a seal between the impeller shaft and the impeller housing is eliminated.

In addition, the fluid flowing around the motor advantageously cools the motor and effectively silences noise generated by the motor to maintain the quiet operation of the pump, which is especially advantageous in residential applications.

The motor is spaced radially inward from a pump motor cover that forms the motor chamber. In the preferred embodiment, the motor is radially spaced from and coupled to the pump motor cover through resilient and preferably elastomeric pads. This minimizes motor vibration transfer to the pump motor cover, thereby enhancing the silencing effect of the fluid flow around the motor.

The above is a brief description of some deficiencies in the prior art and advantages of the present invention. Other features, advantages and embodiments of the invention will be apparent to those skilled in the art from the following description, accompanying drawings and appended claims.

DESCRIPTION OF THE PREFERRED EMBODIMENT

Figure 1:
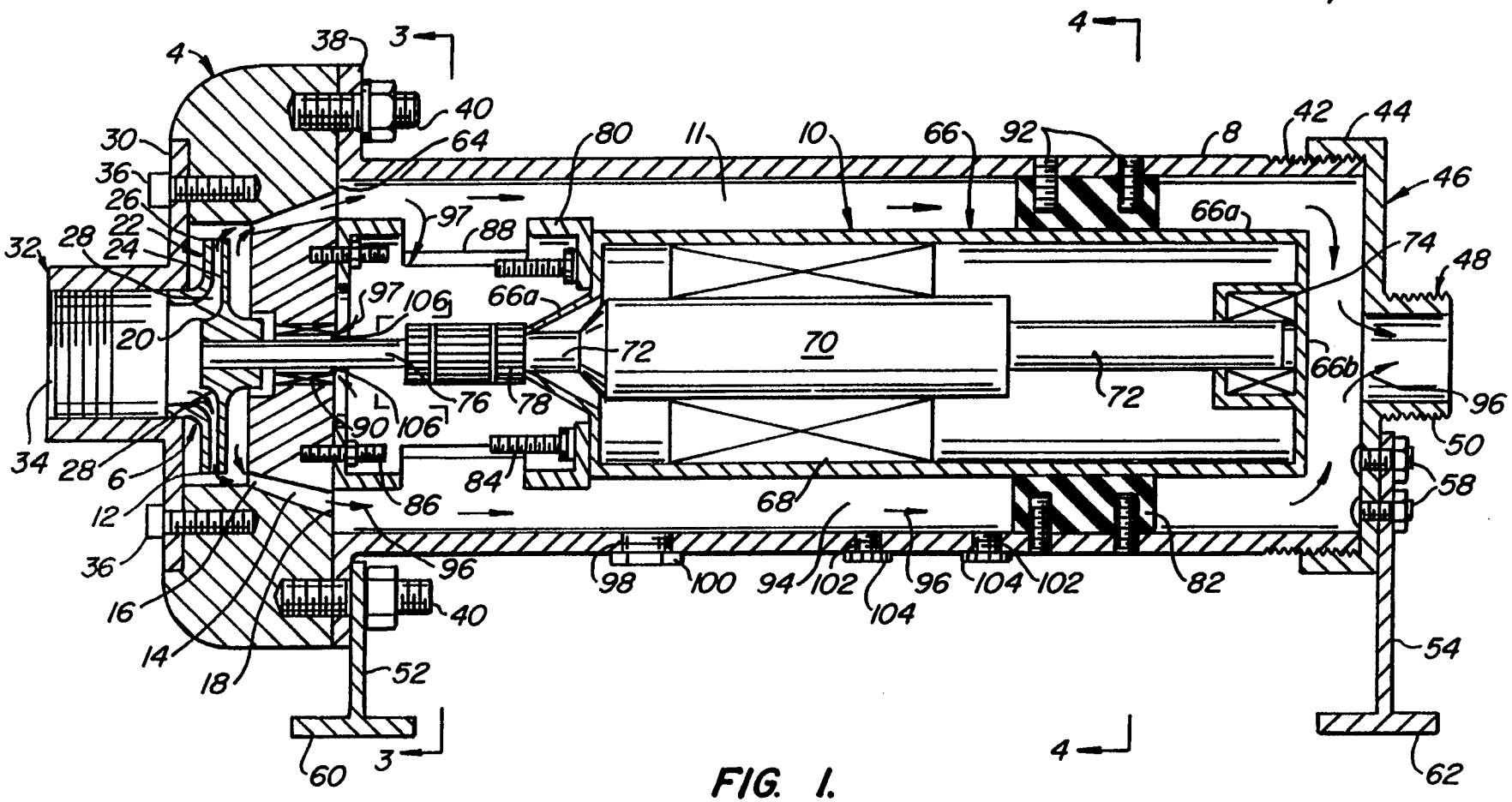
FIG. 1 is a longitudinal sectional view of the pump in accordance with the principles of the present invention.

Referring to the drawings in detail, wherein like numerals indicate like elements, pump 2 is shown in accordance with the principles of the present invention. Pump 2 generally comprises a volute or impeller housing 4, an impeller 6, a generally cylindrical pump motor cover 8 and a motor 10.

Figure 3:
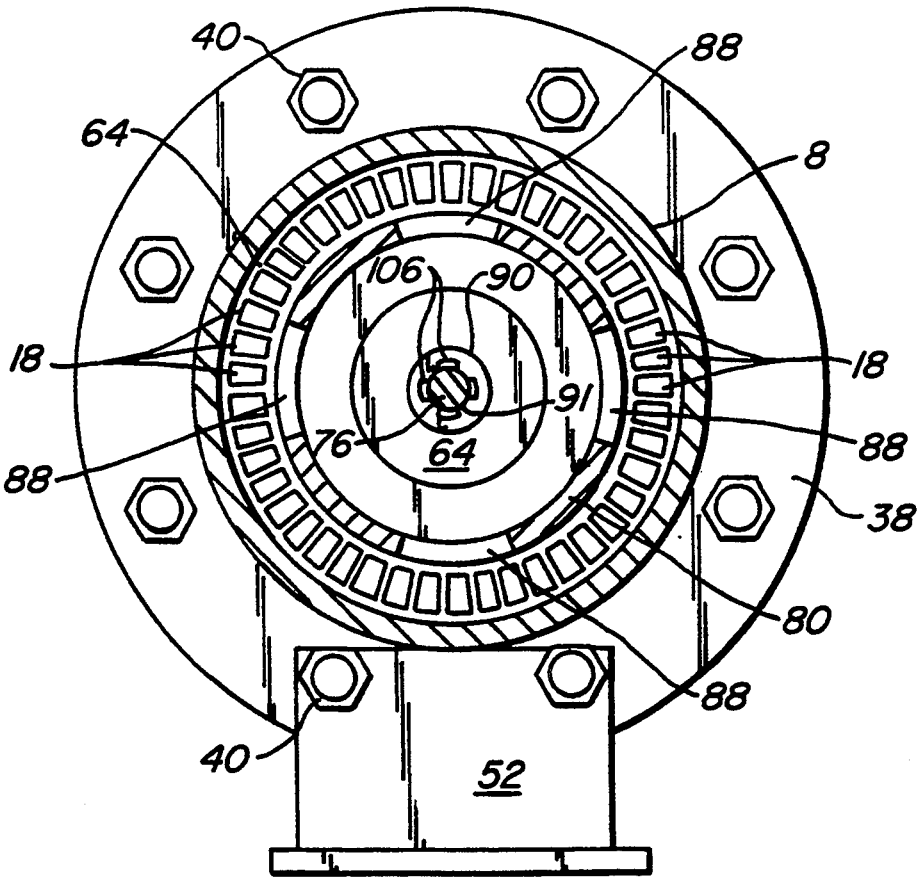
FIG. 3 is a sectional view of the pump taken along line 3—3 in FIG. 1.

Referring to FIG. 1, impeller housing 4 includes an impeller chamber or cavity 12 in which impeller 6 is mounted and a plurality of passageways 14 each having an inlet port 16 in fluid communication with the impeller cavity and an outlet port 18 in fluid communication with the interior of motor cover 8, i.e., motor chamber 11 for discharging fluid from the impeller cavity into chamber 11 and over motor 10, as will be described in more detail below. Referring to FIG. 3, outlet ports 18 are shown as having a generally rectangular configuration. Outlet ports 18 also are shown arranged in a 360° arc so that fluid flow around the entire circumference of motor 10 is achieved. However, other outlet port configurations (such as circular or elliptical) and arrangements can be used to discharge fluid from the impeller housing and over motor 10 without departing from the scope of the present invention. Returning to FIG. 1, impeller housing 4 further includes an annular recess for receiving annular flange 30 of pipe coupling assembly 32 that provides fluid to impeller chamber 12 as is conventional in the art. Thus, pipe coupling assembly 32 can be provided with threads 34 for securing the assembly to a fluid supply line. In addition, annular flange 30 is releasably secured to impeller housing 4 with bolts 36, for example, so that pipe coupling assembly 32 can be readily removed to provide access to impeller 6.

Figure 2:
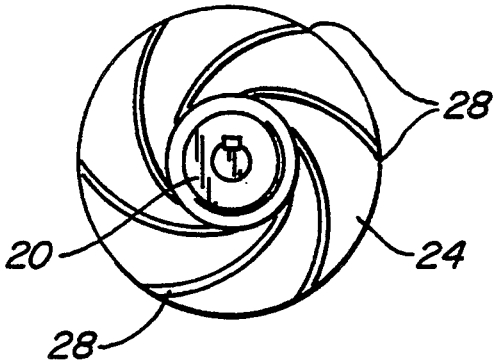
FIG. 2 is an end view of a portion of the pump impeller illustrated in FIG. 1.

Referring to FIGS. 1 and 2, impeller 6 includes a hub 20, which is mounted to impeller shaft 76, and a disc-shaped portion 22 extending therefrom. Disc-shaped portion 22 generally includes inner shroud member 24, outer shroud member 26 (FIG. 1) and a plurality of veins or paddles 28 that extend from hub 20 between shroud members 24, 26 to the outer perimeter of the disc-shaped portion 22.

Figure 4:
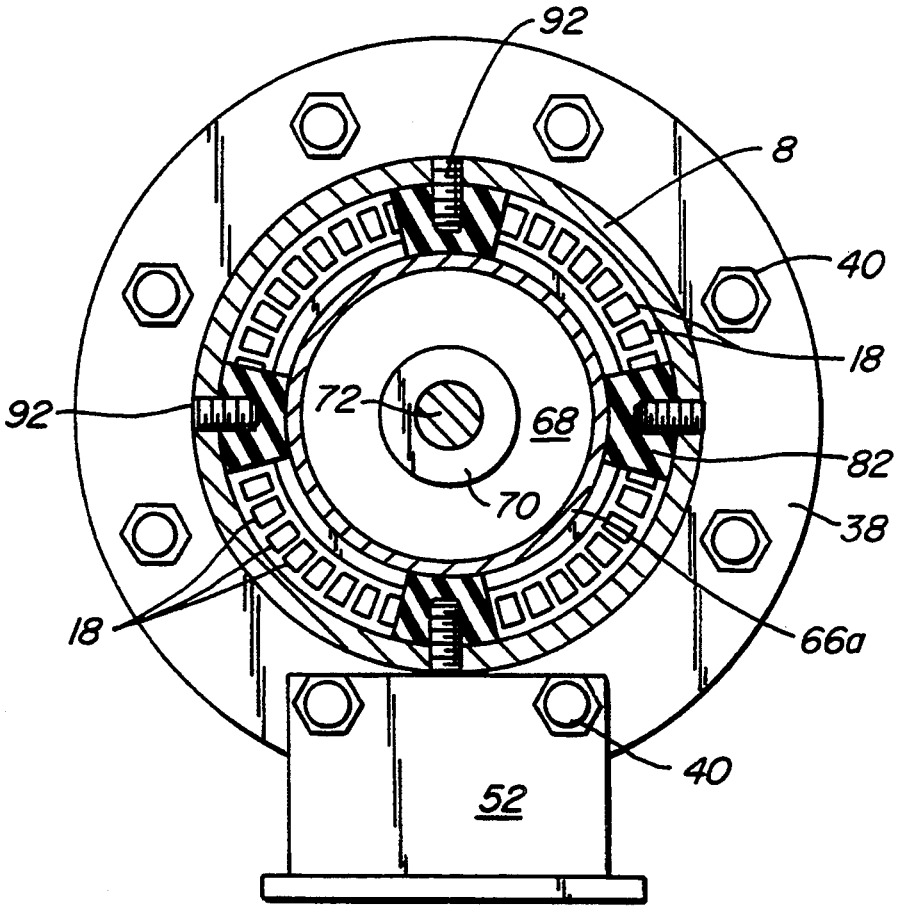
FIG. 4 is a sectional view of the pump taken along line 4—4 in FIG. 1.

Pump motor cover 8, shown as having a cylindrical configuration, has one end coupled to the impeller housing and its opposite end coupled to a discharge head. Specifically, motor cover 8 includes an annular flange 38 that is releasably secured to generally planar end face 64 of impeller housing 4, for example, through nut and bolt fasteners 40. The other end of motor cover 8 includes a threaded portion 42 that cooperatively receives threaded portion 44 of annular discharge head 46 such that the discharge head can be readily removed from the motor cover to provide access at the blind end of motor 10. Discharge head 46 further includes pipe coupling 48. As illustrated in FIG. 1, coupling 48 is integrally formed with and centrally positioned in head 46 to discharge fluid from motor chamber 11. Similar to pipe coupling 32, pipe coupling 48 can be provided with external threading 54 for cooperating with complementary threads associated with a discharge line (not shown). Pump motor cover 8 and head 46 form a shell that defines motor chamber 11 in which motor 10 is mounted. As illustrated in FIGS. 1, 3 and 4, feet 52 and 54 generally have the same configuration and are secured to motor cover 8 and discharge head 46 with fasteners such as threaded bolts 40, 58. Feet 52, 54 support the motor and are provided with through holes (not shown) in their respective base portions 62 to permit the pump to be secured to a surface with through bolts as is conventional in the art. It should be understood, however, that feet having other configurations for supporting the pump and securing it to a surface can be used without departing from the invention.

Motor 10 is a conventional submersible motor. Motor 10 is schematically shown in FIG. 1 and generally comprises cylindrical casing 66, which includes cylindrical portion 66*a* and end faces 66*b* and 66*c*, stator windings 68, rotor 70, and motor shaft 72. The blind end of shaft 72 is rotatably supported in bearing 74. The output end of shaft 72 is supported by a bearing (not shown) and extends through casing end face 66*c* where it is coupled to impeller shaft 76 through a conventional coupling 78. A seal is provided between the opening in end face 66*c* through which shaft 72 extends to prevent fluid from entering casing 66. Suitable submersible motors are commercially available from Franklin Electric Co., Bluffton, Ind., for example.

Motor 10 is mounted within motor chamber 11 through bracket 80 and mounting pads 82. More specifically, end portion 66*c* is secured to bracket 80 by fasteners, such as nut and bolt fasteners 84, and bracket 80 is secured to end face 64 of impeller housing 4 by fasteners such as nut and bolt fasteners 86. Although bracket 80 can have other configurations, it is shown as generally cylindrical. Bracket 80 also includes a plurality of apertures 88 formed through the circumferential portion thereof to permit fluid discharged from outlet ports 18 to flow to impeller bearing 90 for the reasons to be discussed below. Accordingly, bracket 80 is spaced radially inward from discharge outlets 18. Mounting pads 82 are spaced equidistantly around the circumference of casing 66 toward the blind end of motor 10 and are secured to motor cover 8 through set screws 92, for example. Mounting pads 82 preferably are elastomeric material to absorb motor vibration and minimize transfer of motor noise to motor cover 8.

Motor bracket 80 and casing 66 are spaced radially inward from motor cover 8 so that an annular chamber 94 is formed between the motor and bracket assembly and motor cover 8. Accordingly, fluid discharged from passageways 14 flows downstream through annular channel 94 around motor 10 and out of the pump through the discharge port formed by pipe coupling 8. This fluid flow is generally indicated by arrows 96. The secondary flow between the motor and impeller chambers through bearing 90, generally indicated by arrow 97, is discussed below.

Referring to FIGS. 1 and 3, impeller shaft 76 is rotatably supported within inner circumferential surface 91 of bearing 90 which is pressure fit in impeller housing 4. Clearance is provided between the impeller shaft and the bearing so that a film of fluid having a thickness sufficient to effectively lubricate the interface between the impeller shaft and bearing and to maintain the clearance space therebetween is formed for reasons discussed hereafter. Bearing 90 includes a plurality of axial grooves 106 formed in surface 91. Each groove 106 has an inlet in fluid communication with outlet port 18 and annular channel 94 through bracket apertures 88. Each groove also has an outlet fluidly coupled to impeller cavity 12. Although the bearing has been described as having axial grooves or grooves otherwise configured, spiral grooves can be used as will be apparent from the following.

During operation, motor 10 is energized to rotate impeller 6. As impeller 6 rotates, fluid is drawn into impeller chamber 12, pumped through passageways 18 into motor chamber 11 where the fluid flows through annular channel 94 from which is it discharged through the discharge port formed by pipe coupling 48. Some of the fluid discharged from passageways 14 (designated by arrow 97) flows through bracket apertures 88 toward bearing 90, enters axial grooves 106 and is recirculated back to impeller cavity 12 due to a pressure differential that develops between opposite sides of the bearing. However, it has been found when the pressure in the line coupled to downstream pipe coupling 48 is low, for example, below 1 psi, the secondary flow through bearing 90 occurs in a direction from impeller cavity 12 to motor chamber 11. Thus, fluid flows into the groove from the impeller or motor chamber depending on the pressure gradient across the bearing, which varies according to downstream conditions. In either case, as the impeller shaft rotates, fluid from the grooves forms a thin film in the clearance space between the impeller shaft and bearing to effectively lubricate the interface therebetween.

Merely to exemplify a preferred bearing configuration, the following example may be recited. It is understood that this example is given by way of illustration and not intended to limit the scope of this invention. For an impeller shaft having a one-half inch diameter the bearing is selected to have a one inch outer diameter and a one-half inch inner diameter machined to provide a 0.003 inch clearance between the bearing and the shaft. Four axial grooves are provided as shown in FIG. 3 and each groove has a 0.031 inch depth, 0.125 inch width and one inch length. The axial length of the bearing is one inch. The bearing preferably is made of brass and the impeller housing of cast iron.

Referring to FIG. 1, motor cover 8 includes a plurality of ports that provide access to the motor chamber. Specifically, motor cover 8 includes access port 98 in which threaded plug 100 is seated. Threaded plug 100 serves as a wire conduit for power input lines to the motor leads (not shown). That is, the motor leads pass through the cap of plug 100 in a sealing relationship therewith so that fluid does not leak from the motor chamber through plug 100. Access ports 102, having threaded plugs 104 seated therein, provide access to the annular channel for measuring instruments such as pressure gauges or thermocouples to monitor fluid pressure and temperature. Access ports 102 also provide a mechanism for injecting chemicals into the fluid flow. In this way, the pumped fluid can be oxygenated. Alternatively, fertilizer can be added through ports 102 in agricultural applications. In a further example, chlorine can be added to the fluid for sanitation purposes and other chemicals added to adjust pH when the pump is used in conjunction with swimming pools.

The above is a detailed description of a particular embodiment of the invention. It is recognized that departures from the disclosed embodiment may be made within the scope of the invention and that obvious modifications will occur to a person skilled in the art. The full scope of the invention is set out in the claims that follow and their equivalents. Accordingly, the claims and specification should not be construed to unduly narrow the full scope of protection to which the invention is entitled.

What is claimed is:

1. A pump comprising:

a tubular shell that defines a motor chamber;

a motor disposed in said motor chamber and spaced from said shell such that a channel is formed therebetween, said motor having an output shaft;

an impeller housing coupled to said shell, said impeller housing having a cavity and a passageway formed therein, said passageway having an inlet in fluid communication with said cavity and an outlet in fluid communication with said channel;

an impeller disposed in said cavity;

an impeller shaft having a first portion coupled to said impeller and a second portion coupled to said output shaft; and a bearing coupled to said impeller housing, said bearing having an inner circumferential surface defining an opening through which said impeller shaft extends, said surface having a groove formed therein that extends between and fluidly couples said cavity and motor chamber.

2. The pump of claim 1 wherein said shell includes a discharge port in fluid communication with said channel through which fluid pumped by said impeller into said channel can be discharged.

3. The pump of claim 1 wherein said channel is generally annular.

4. The pump of claim 1 wherein said channel is substantially unobstructed.

5. The pump of claim 1 including circumferentially spaced pads that extend radially from said motor casing and coupled to said tubular motor cover for supporting the motor within said cover.

6. The pump of claim 5 wherein said pads comprise elastomeric material.

7. A pump comprising:

a motor having a casing and an output shaft;

a tubular motor cover having a first portion that surrounds and is radially spaced from said motor casing and a second portion which surrounds said output shaft;

an impeller housing coupled to said motor cover, said impeller housing having a cavity and a passageway formed therein, said passageway having an inlet in fluid communication with said cavity and an outlet in fluid communication with the interior of said tubular motor cover;

an impeller disposed in said first cavity;

an impeller shaft having a first portion extending from said impeller and a second portion coupled to said output shaft of the motor; and a bearing disposed in said impeller housing and having a hole through which said impeller shaft extends, said bearing having a groove formed therein which together with the impeller shaft forms a channel, said channel having an inlet and outlet, said inlet being in fluid communication with the interior of said tubular motor cover, and said channel outlet being in fluid communication with said cavity in the impeller housing.

8. The pump of claim 7 wherein said passageway is spaced radially inward from said tubular motor cover.

9. The pump of claim 7 wherein said impeller includes a hub and a generally disc-shaped portion extending therefrom, said disc-shaped portion having a plurality of vanes extending substantially from said hub to the outer perimeter of said disc-shaped portion, said passageway inlet being in the vicinity of the outer perimeter of said generally disc-shaped portion and said channel outlet being in the vicinity of said hub.

10. The pump of claim 7 wherein said impeller housing includes a plurality of said passageways, each having an inlet in fluid communication with said cavity and an outlet in fluid communication with the interior of said tubular motor cover.

11. The pump of claim 10 wherein said bearing includes a plurality of said grooves which together with the impeller shaft form a plurality of channels, each having an inlet and outlet, each channel inlet being in fluid communication with the interior of said tubular motor cover, and each channel outlet being in fluid communication with the cavity in the impeller housing.

12. The pump of claim 10 wherein said impeller includes a hub and a generally disc-shaped portion extending therefrom, said disc-shaped portion having a plurality of vanes extending substantially from said hub to the outer perimeter of said disc, said passageway inlets being in the vicinity of the outer perimeter of said generally disc-shaped portion.

13. A pump comprising:

an impeller housing having a cavity and a passageway formed therein, said passageway having an inlet port in fluid communication with said cavity and an outlet port;

an impeller positioned in said cavity;

a motor having an output shaft extending from one end thereof and a tubular outer casing;

an impeller shaft having first and second portions, said first portion being coupled to said impeller and said second portion being coupled to said output shaft of the motor;

a bracket having first and second end portions, said first bracket end portion being coupled to said impeller housing and said second bracket end portion being coupled to said motor casing, said bracket having an opening formed therethrough between said first and second bracket end portions;

a tubular motor cover having a first end portion extending from said impeller housing and a second end portion, said motor cover being spaced radially outward from said bracket and motor casing such that a first channel is formed between said motor cover and said bracket and casing, said first channel being in fluid communication with said passageway outlet port and bracket opening; and a bearing disposed in said impeller housing, said bearing rotatably supporting said impeller shaft and having a groove that forms a second channel with said impeller shaft, said second channel having an inlet in fluid communication with said first channel through said bracket opening and an outlet in fluid communication with the impeller housing cavity.

14. The pump of claim 13 wherein said passageway outlet is positioned between said bracket and said tubular motor cover.

15. The pump of claim 13 wherein said impeller includes a hub and a generally disc-shaped portion extending therefrom, said disc-shaped portion having a plurality of vanes extending substantially from said hub to the outer perimeter of said disc, said passageway inlet being in the vicinity of the outer perimeter of said generally disc-shaped portion and said second channel outlet being in the vicinity of said hub.

16. The pump of claim 13 including a head member coupled to said second end portion of said tubular motor cover and axially spaced from said motor casing, said head member including a discharge opening in fluid communication with said first channel to discharge fluid flowing over the motor from the pump.

17. The pump of claim 13 wherein said first channel is generally annular.

18. The pump of claim 13 wherein said tubular motor cover includes an access port in fluid communication with said first channel and a plug removably coupled to said access port.

* * * * *